US011686084B2

(12) United States Patent
Chen et al.

(10) Patent No.: US 11,686,084 B2
(45) Date of Patent: Jun. 27, 2023

(54) PREFABRICATED CONCRETE BEAM-COLUMN NODE AND CONSTRUCTION METHOD THEREFOR

(71) Applicant: HAINAN UNIVERSITY, Hainan (CN)

(72) Inventors: Yun Chen, Hainan (CN); Qijun Zhang, Hainan (CN)

(73) Assignee: HAINAN UNIVERSITY, Hainan (CN)

( * ) Notice: Subject to any disclaimer, the term of this patent is extended or adjusted under 35 U.S.C. 154(b) by 0 days.

(21) Appl. No.: 17/624,274

(22) PCT Filed: Feb. 10, 2021

(86) PCT No.: PCT/CN2021/076428
§ 371 (c)(1),
(2) Date: Dec. 31, 2021

(87) PCT Pub. No.: WO2022/160388
PCT Pub. Date: Aug. 4, 2022

(65) Prior Publication Data

US 2022/0349171 A1 Nov. 3, 2022

(30) Foreign Application Priority Data

Jan. 27, 2021 (CN) ..... 202110113801.9

(51) Int. Cl.
*E04B 1/21* (2006.01)
*E04B 1/30* (2006.01)
*E04C 3/293* (2006.01)

(52) U.S. Cl.
CPC ..... *E04B 1/215* (2013.01); *E04B 1/30* (2013.01); *E04C 3/293* (2013.01)

(58) Field of Classification Search
CPC ..... E04B 1/215; E04B 1/30; E04C 3/293
(Continued)

(56) References Cited

U.S. PATENT DOCUMENTS 3,513,610 A * 5/1970 Devonport ..... B28B 23/00 52/283
3,562,979 A * 2/1971 Ali-Oglu ..... E04B 1/215 52/577

(Continued)

FOREIGN PATENT DOCUMENTS

CN 106481023 A 3/2017
CN 107905363 A 4/2018

(Continued)

OTHER PUBLICATIONS

International Search Report for PCT/CN2021/076428 dated Oct. 26, 2021, ISA/CN.

*Primary Examiner* — Brian D Mattei
*Assistant Examiner* — Joseph J. Sadlon
(74) *Attorney, Agent, or Firm* — Yue (Robert) Xu; Apex Attorneys at Law, LLP

(57) ABSTRACT

The present application relates to a prefabricated concrete beam-column node and a construction method thereof. The construction method of the prefabricated concrete beam-column node includes: assembling node connectors, and mounting studs on each node connector; welding a circumferential reinforcing plate with a groove hole in the center to a middle-rear section of each node connector; mounting a longitudinal rebar on each circumferential reinforcing plate; pouring a concrete beam between two circumferential reinforcing plates; welding a hidden corbel to a side flange of each of structural columns; hoisting the concrete beam, and overlapping each node connector with the corresponding hidden corbel; welding each node connector to the corresponding structural column; and pouring the concrete beam between the circumferential reinforcing plates and the structural columns.

9 Claims, 3 Drawing Sheets

(58) Field of Classification Search
USPC ..... 52/745.19
See application file for complete search history.

(56) References Cited

U.S. PATENT DOCUMENTS

| | | | | | |
|---|---|---|---|---|---|
| 3,594,971 | A * | 7/1971 | Hughes | E04B 1/215 | 52/432 |
| 3,600,863 | A * | 8/1971 | Nachtsheim | E04B 1/215 | 52/764 |
| 3,733,757 | A * | 5/1973 | Scott | E04B 1/215 | 52/250 |
| 3,971,179 | A * | 7/1976 | Bodocsi | E04B 1/24 | 52/272 |
| 3,999,735 | A * | 12/1976 | Brownlee | E04B 1/215 | 249/19 |
| 4,060,948 | A * | 12/1977 | Brownlee | E04B 1/21 | 249/19 |
| 4,211,045 | A * | 7/1980 | Koizumi | E04B 5/43 | 52/432 |
| 4,295,310 | A * | 10/1981 | McManus | E04B 5/29 | 52/334 |
| 4,330,970 | A * | 5/1982 | Bonink | E04B 1/215 | 52/236.7 |
| 4,378,664 | A * | 4/1983 | Andaya | E04B 1/21 | 52/745.13 |
| 4,819,394 | A * | 4/1989 | Compton | E04B 1/215 | 52/252 |
| 5,279,093 | A * | 1/1994 | Mead | B28B 7/0044 | 52/841 |
| 5,410,847 | A * | 5/1995 | Okawa | E04B 1/30 | 52/272 |
| 5,634,308 | A * | 6/1997 | Doolan | E04B 5/29 | 52/327 |
| 6,474,902 | B1 * | 11/2002 | Beauvoir | F16B 9/058 | 403/403 |
| 6,543,195 | B2 * | 4/2003 | Rahimzadeh | E04B 5/29 | 52/327 |
| 8,291,676 | B2 * | 10/2012 | Hong | E04C 3/293 | 52/340 |
| 8,434,279 | B2 * | 5/2013 | Kim | E04C 3/291 | 52/841 |
| 8,453,406 | B2 * | 6/2013 | Platt | E04C 3/294 | 14/73.1 |
| 8,671,634 | B2 * | 3/2014 | Morcous | E04B 5/43 | 52/258 |
| 9,096,999 | B2 * | 8/2015 | Rahimzadeh | E04C 3/293 | |
| 10,260,225 | B2 * | 4/2019 | Lee | E04C 5/0645 | |
| 10,407,893 | B2 * | 9/2019 | Marcaccioli | E04C 3/294 | |
| 10,597,864 | B1 * | 3/2020 | Pearson | E04B 1/2403 | |
| 11,105,084 | B1 * | 8/2021 | Cui | E04C 3/293 | |
| 11,225,786 | B2 * | 1/2022 | Yu | E04B 1/215 | |
| 11,326,345 | B2 * | 5/2022 | Kim | E04C 3/06 | |
| 11,377,841 | B2 * | 7/2022 | Kurosawa | E04B 1/215 | |
| 2011/0094182 | A1 | 4/2011 | Kim et al. | | |
| 2019/0226210 | A1 * | 7/2019 | Yin | E04C 3/04 | |

FOREIGN PATENT DOCUMENTS

| | | | | |
|---|---|---|---|---|
| CN | 208293758 | U | | 12/2018 |
| CN | 209244091 | U | | 8/2019 |
| CN | 110820954 | A | | 2/2020 |
| CN | 210216720 | U | | 3/2020 |
| CN | 210421404 | U | * | 4/2020 |
| CN | 210421404 | U | | 4/2020 |
| KR | 100864604 | B1 | | 10/2008 |
| KR | 20090042121 | A | | 4/2009 |

* cited by examiner

PREFABRICATED CONCRETE BEAM-COLUMN NODE AND CONSTRUCTION METHOD THEREFOR

The present application is the National phase of International Application No. PCT/CN2021/076428, titled "PREFABRICATED CONCRETE BEAM-COLUMN NODE AND CONSTRUCTION METHOD THEREFOR", filed on Dec. 25, 2021, which claims the priority to Chinese Patent Application No. 202110113801.9, titled "PREFABRICATED CONCRETE BEAM-COLUMN NODE AND CONSTRUCTION METHOD THEREFOR", filed with the China National Intellectual Property Administration on Jan. 27, 2021, all of which are incorporated herein by reference.

FIELD

The present application relates to the technical field of construction, and more specifically, to a construction method for a prefabricated concrete beam-column node. In addition, a prefabricated concrete beam-column node used in the construction method for the prefabricated concrete beam-column node is further provided according to the present application.

BACKGROUND

Since an on-site construction method has disadvantages of lower production efficiency, serious waste of resources, poor quality control, and great negative impact on the environment, a prefabricated building characterized by "industrialization in component production and modularization in construction operation" came into being.

In order to ensure that the prefabricated building can exert its overall force-bearing performance, it is necessary to connect components through node, so that the components are stressed together under a loaded state. Due to the complex stressed mechanism of the building structure, the node is generally not in a uniaxial stressed state, and the node is required to have sufficient strength and rigidity to bear and transfer complex force while ensuring small deformation.

It is too costly to construct a prefabricated building just with steel structural parts, which is difficult to promote in civil buildings. A concrete prefabricated building is economical and practical, but the construction condition is complex and the operation is cumbersome. The existing connecting method of concrete prefabricated building mainly includes dry connection and wet connection. Dry connection is welding or bolt connection. The construction steps of welding are relatively complicated, and the quality of welding is easily affected by material and operation proficiency. Bolt connection requires multiple rows of bolt holes on the component, and the construction speed is slow. Wet connection is realized by pouring concrete afterward. A formwork is required for concrete pouring, the construction is complicated, the operation is cumbersome, and the construction requirement is high, and the construction speed is therefore slow.

In summary, how to simplify a construction method for a concrete prefabricated building is a problem to be solved by those skilled in the art.

SUMMARY

In view of this, an object according to the present application is to provide a construction method for a prefabricated concrete beam-column node, which simplifies welding connection and performs step-by-step pouring of a concrete beam, greatly simplifies the construction procedure and reduces the construction difficulty.

In addition, a prefabricated concrete beam-column node used in the construction method for the prefabricated concrete beam-column node is further provided according to the present application.

In order to achieve the above objects, the following technical solutions are provided in the present application:

A construction method for a prefabricated concrete beam-column node includes:

- assembling node connectors, and mounting studs on each node connector;
- welding a circumferential reinforcing plate with a groove hole in the center to a middle-rear section of each node connector;
- mounting a longitudinal rebar on each circumferential reinforcing plate;
- pouring a concrete beam between two circumferential reinforcing plates;
- welding a hidden corbel to a side flange of each of structural columns;
- hoisting the concrete beam, and overlapping each node connector with the corresponding hidden corbel;
- welding each node connector to the corresponding structural column; and
- pouring the concrete beam between the circumferential reinforcing plates and the structural columns.

Preferably, the mounting studs on each node connector includes:

- mounting studs on a rear end of an upper flange steel plate of each node connector;
- mounting studs on a lower flange steel plate of each node connector; and
- mounting studs on a side steel plate located on two sides of each node connector.

Preferably, the overlapping each node connector with the corresponding hidden corbel includes:

- overlapping each node connector with the corresponding hidden corbel through a hidden corbel mounting hole on the node connector; and
- repairing welding to plug each hidden corbel mounting hole.

Preferably, the pouring a concrete beam between two circumferential reinforcing plates includes:

- plugging the groove hole on each circumferential reinforcing plate; and
- placing a pair of the node connectors mounted with the longitudinal rebar into a formwork, and pouring the concrete beam between the two circumferential reinforcing plates.

Preferably, the pouring the concrete beam between the circumferential reinforcing plates and the structural columns includes:

- removing a plugging material in each groove hole; and
- jacketing a mold over a joint between each structural column and the corresponding node connector; and
- pouring concrete through a grouting port of each node connector.

A prefabricated concrete beam-column node includes structural columns, a concrete beam, and node connectors connecting the structural columns with the concrete beam. The node connectors are horizontally arranged at two ends of the concrete beam, and a grouting port is defined on an upper surface of each node connector.

A circumferential reinforcing plate is arranged in each node connector, and a through groove hole is defined on each circumferential reinforcing plate.

A hidden corbel is welded to a side flange of each structural column, each hidden corbel is pre-embedded in the concrete beam, and, the hidden corbels and the structural columns are welded to the node connectors.

Preferably, multiple reserved rebar holes for mounting longitudinal rebars are defined on each circumferential reinforcing plate, and the longitudinal rebars are configured to connect the concrete beam on two sides of each circumferential reinforcing plate.

Preferably, each node connector includes an upper flange steel plate in contact with an upper flange of the concrete beam, a lower flange steel plate in contact with a lower flange of the concrete beam, and a side steel plate. The side steel plate is configured to connect the upper flange steel plate with the lower flange steel plate.

The grouting port is defined at a front end of each upper flange steel plate.

Preferably, each structural column includes a steel column or a concrete column, and a hoop plate is provided on an outer circumference of each concrete column.

In the construction method for the prefabricated concrete beam-column node according to the present application, the side flange of each structural column is welded to the corresponding hidden corbel, the hidden corbel can support the upper surface of the corresponding node connector to a certain extent, and since the hidden corbels are connected to the structural columns and the node connectors, the arrangement of the hidden corbels increases the connection strength between the node connectors and the structural columns, and increases the bending resistance of the two ends of the concrete beam.

The concrete beam can be divided into a middle section between the two circumferential reinforcing plates and connection sections between the circumferential reinforcing plates and adjacent structural columns. The middle section and the connection sections are constructed step by step. The volume of concrete to be poured is small and the pouring shape is regular, which reduces the construction difficulty of pouring.

Since the welding process is only used at the node connectors and the joints between the node connectors and the structural columns, positions to be welded are reduced, and the structure of the welding portion is simplified, which further reduces the construction difficulty of the welding. For wet connection with complex construction condition, cumbersome procedure and long construction period, compared with integral pouring, the step-by-step pouring has a small volume in single pouring and a regular pouring shape, which greatly reduces the construction difficulty.

Therefore, the construction method for the prefabricated concrete beam-column node according to the present application ensures the structural strength of the concrete beam-column node, and is economical, effective, and convenient for construction.

In addition, the prefabricated concrete beam-column node used in the construction method for the prefabricated concrete beam-column node is further provided according to the present application.

BRIEF DESCRIPTION OF THE DRAWINGS

For more clearly illustrating embodiments of the present application or the technical solutions in the conventional technology, drawings referred to for describing the embodiments or the conventional technology will be briefly described hereinafter. The drawings in the following description are only examples of the present application, and for those skilled in the art, other drawings may be obtained based on the provided drawings without any creative efforts.

Figure 1:
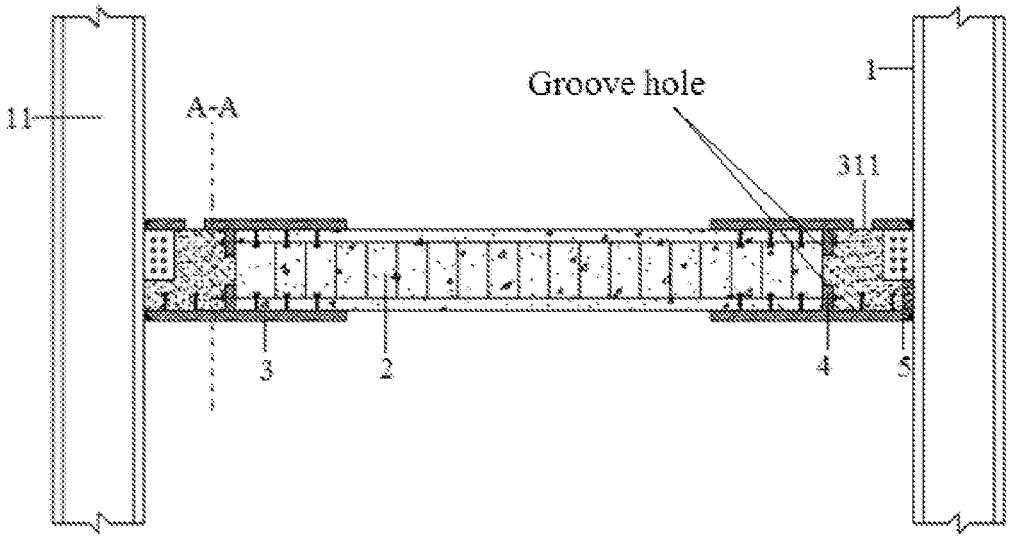
FIG. 1 is a schematic structural view of a prefabricated concrete beam-column node according to a first specific embodiment of the present application.

The reference numerals in FIGS. 1 to 4 are as follows:

1 structural column,
11 steel column,
12 concrete column,
121 hoop plate,
2 concrete beam,
3 node connector,
31 upper flange steel plate,
311 grouting port,
32 lower flange steel plate,
33 side steel plate,
4 circumferential reinforcing plate,
5 hidden corbel,
6 longitudinal rebar,
7 corbel.

DETAILED DESCRIPTION OF THE EMBODIMENTS

The technical solutions according to the embodiments of the present application will be described clearly and completely as follows in conjunction with the drawings in the embodiments of the present application. It is apparent that the described embodiments are only a part of the embodiments according to the present application, rather than all the embodiments. Based on the embodiments in the present application, all of other embodiments, made by the those skilled in the art without any creative efforts, fall into the scope of the present application.

A core according to the present application is to provide a construction method for a prefabricated concrete beam-column node, which simplifies welding connection and performs step-by-step pouring of a concrete beam, greatly simplifies the construction procedure and reduces the construction difficulty.

A prefabricated concrete beam-column node used in the construction method for the prefabricated concrete beam-column node is further provided according to the present application.

Figure 2:
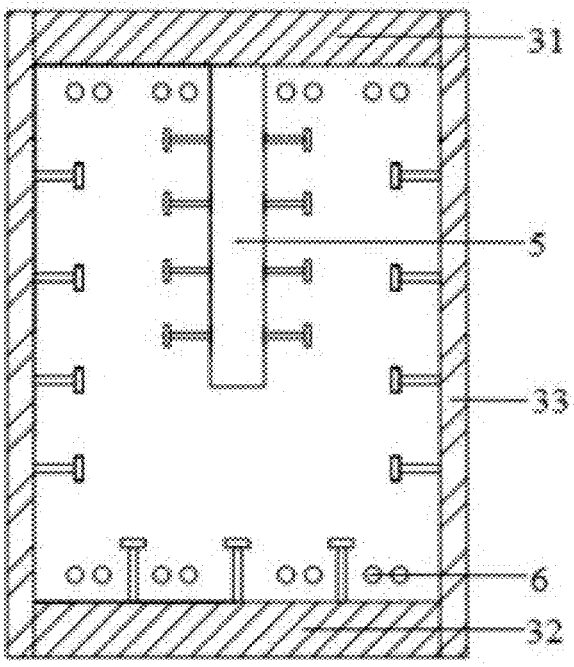
FIG. 2 is a schematic sectional view of an A-A section in FIG. 1.
Figure 3:
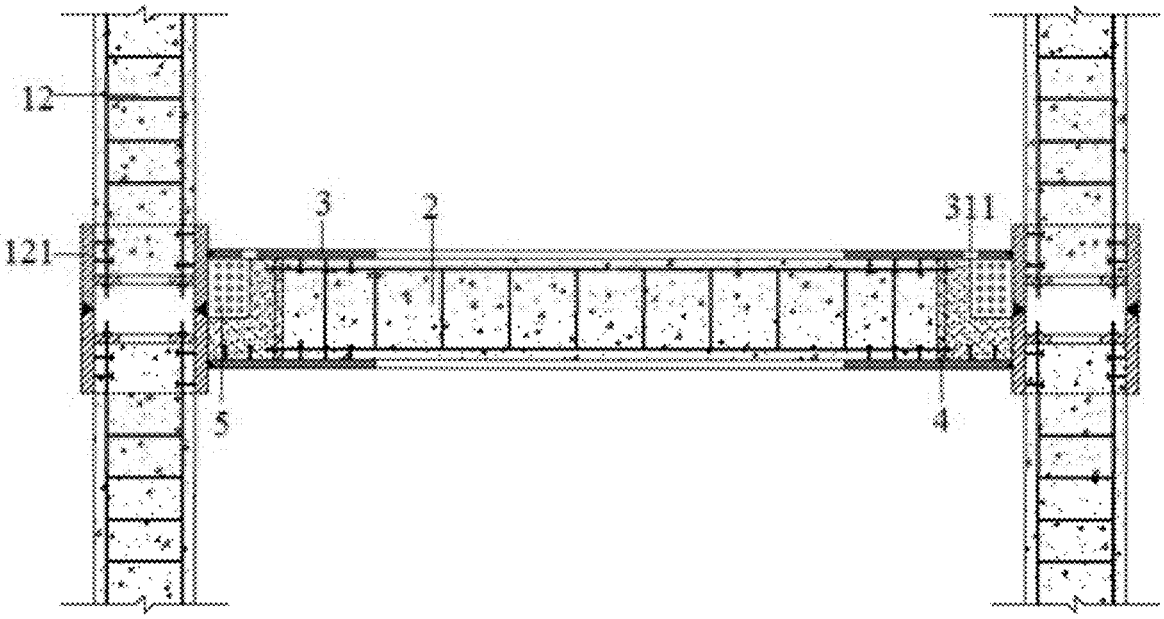
FIG. 3 is a schematic structural view of the prefabricated concrete beam-column node according to a second specific embodiment of the present application.
Figure 4:
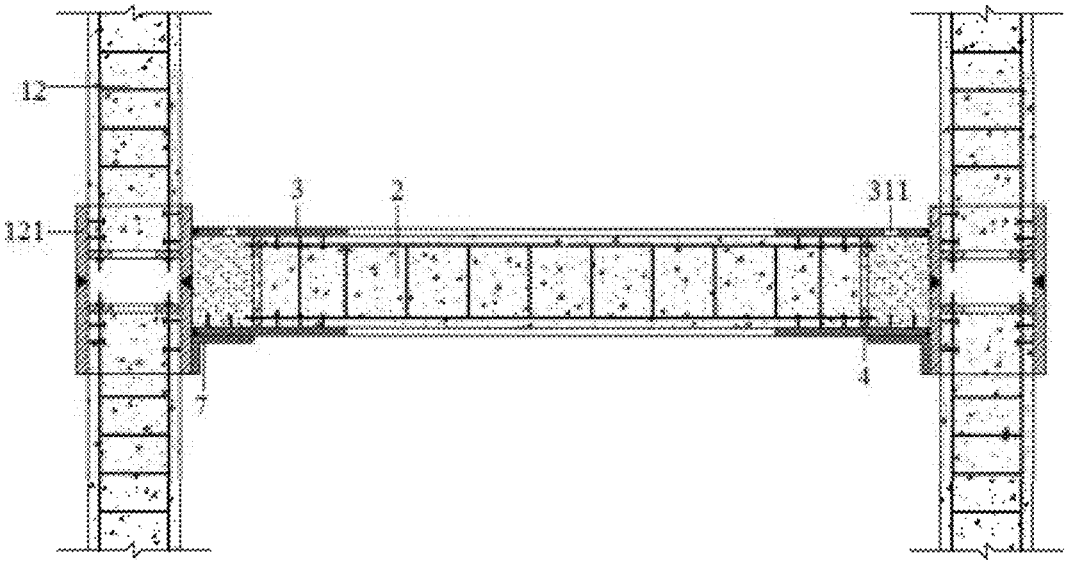
FIG. 4 is a schematic structural view of the prefabricated concrete beam-column node according to a third specific embodiment of the present application.

Referring to FIGS. 1 to 4, FIG. 1 is a schematic structural view of a prefabricated concrete beam-column node according to a first specific embodiment of the present application; FIG. 2 is a schematic sectional view of an A-A section in FIG. 1; FIG. 3 is a schematic structural view of the prefabricated concrete beam-column node according to a second specific embodiment of the present application; and FIG. 4 is a schematic structural view of the prefabricated concrete beam-column node according to a third specific embodiment of the present application.

It should be noted that, a rear end mentioned herein refers to an end relatively close to a concrete beam 2, and a front end refers to an end relatively close to a structural column 1.

A construction method for a prefabricated concrete beam-column node according to the present application includes:

step S1, assembling node connectors 3, and mounting studs on each node connector 3;

step S2, welding a circumferential reinforcing plate 4 with a groove hole in the center to a middle-rear section of each node connector 3;

step S3, mounting a longitudinal rebar 6 on each circumferential reinforcing plate 4;

step S4, pouring a concrete beam 2 between two circumferential reinforcing plates 4;

step S5, welding a hidden corbel 5 to a side flange of each of structural columns 1;

step S6, hoisting the concrete beam 2, and overlapping each node connector 3 with the corresponding hidden corbel 5;

step S7, welding each node connector 3 to the corresponding structural column 1; and step S8, pouring the concrete beam 2 between the circumferential reinforcing plates 4 and the structural columns 1.

It should be explained for the step S1 that the studs are welded to an inner wall of each node connector 3, so as to be pre-embedded in the concrete beam 2 through the subsequent pouring process of the concrete beam 2 to increase the connection strength between the node connectors 3 and the concrete beam 2. A length of the studs can be determined according to a design height of the concrete beam 2 in actual construction process, which prevents too short length of the studs from affecting the connection strength or too long length of the studs from affecting the structural strength of the concrete beam 2.

The lengths of the node connectors 3 at two ends of the concrete beam 2 may be the same or different. Preferably, the lengths of the node connectors 3 at the two ends of the concrete beam 2 may be set to be the same, so as to facilitate calculation during processing.

Preferably, the studs are evenly distributed in a length direction of the concrete beam 2, so that the force is relatively uniformly distributed on the node connectors 3.

Preferably, the mounting studs on each node connector 3 includes:

step S11, mounting studs on a rear end of an upper flange steel plate 31 of each node connector 3;

step S12, mounting studs on a lower flange steel plate 32 of each node connector 3; and step S13, mounting studs on a side steel plate 33 located on two sides of each node connector 3.

It should be explained for the step S11 that, considering that a grouting port 311 for pouring the concrete beam 2 is reserved at a front end of each upper flange steel plate 31, the studs are only arranged at a rear end of each upper flange steel plate 31.

The studs are welded to an inner wall of each upper flange steel plate 31, an inner wall of each lower flange steel plate 32 and an inner wall of each side steel plate 33. Preferably, a spacing of the studs on each upper flange steel plate 31, a spacing of the studs on each lower flange steel plate 32 and a spacing of the studs on each side steel plate 33 may be the same.

It should be explained for the step S2 that, each circumferential reinforcing plate 4 is welded between the upper flange steel plate 31 and the lower flange steel plate 32 of each node connector 3 by fillet weld. A specific position of the circumferential reinforcing plate 4 on each node connector 3 is determined according to actual construction requirements such as a design length of the concrete beam 2, and a length of a pouring formwork. Preferably, the circumferential reinforcing plates 4 of the node connectors 3 at two ends of the concrete beam 2 can be set to have the same length from an end of each node connector 3 away from the corresponding structural column 1.

It should be explained for the step S3 that, the longitudinal rebar 6 is configured to connect the concrete beam 2 on two sides of the circumferential reinforcing plate 4, and improve the tensile and bending strength of the concrete beam 2 on sections where the circumferential reinforcing plates 4 are located.

Preferably, the step S3 may include:

step S31, combining the longitudinal rebars 6 and stirrups according to a reinforcement ratio; and step S31, inserting ends of the combined longitudinal rebars 6 into reserved rebar holes of circumferential reinforcing plates 4, and fixing the ends.

Preferably, the reserved rebar holes are evenly distributed on the section where each circumferential reinforcing plate 4 is located.

It should be explained for the step S5 that, the hidden corbel 5 is perpendicularly welded to the side flange of each structural column 1 by fillet weld, so that the node connectors 3 are supported by the hidden corbels 5 and the connection strength of the joints between the structural columns 1 and the node connectors 3 is increased. A size and a shape of the hidden corbels 5 are determined according to actual construction requirements with reference to the conventional technology, which may not be repeated here.

Each structural column 1 mainly includes two types: steel column 11 and concrete column 12. For the steel column 11, the hidden corbel 5 can be directly welded to the side flange of each steel column 11. For the concrete column 12, a hoop plate 121 is provided on the side flange of each concrete column 12, and since the hoop plate 121 is a steel plate, the hidden corbel 5 can be directly welded to the hidden corbel 5.

In addition, the hidden corbel 5 may be replaced with a corbel 7, and the corbel 7 is welded between a lower flange of the concrete beam 2 and the side flange of each structural column 1, as shown in FIG. 4.

It should be explained for the step S6 that, the concrete beam 2 is lifted by a crane or other lifting device. The standard for hoisting in place is that the node connectors 3 on two sides of the concrete beam 2 are in contact with the side flanges of the structural columns 1 and lower surfaces of the upper flange steel plates 31 of the node connectors 3 are in contact with upper surfaces of the hidden corbels 5.

Preferably, each hidden corbel 5 is arranged in a symmetrical plane of each node connector 3, and each hidden corbel 5 has the best support effect on the corresponding upper flange steel plate 31.

Preferably, the step S6 may include:

step S61, overlapping each node connector 3 with the corresponding hidden corbel 5 through a hidden corbel mounting hole on the node connector 3; and step S62, repairing welding to plug each hidden corbel mounting hole.

The hidden corbel mounting hole may be arranged on the lower flange steel plate 32 or the side steel plate 33 of each node connector 3. A size of the hidden corbel mounting hole should meet the operating space requirement for the mounting of each hidden corbel 5.

It should be explained for the step S7 that, each node connector 3 is connected to the corresponding structural column 1 by fillet weld. Referring to FIG. 2, the inner wall of the upper flange steel plate 31 of each node connector 3 is welded to an upper end surface of the corresponding hidden corbel 5, a side surface of each upper flange steel plate 31 and a side surface of each lower flange steel plate 32 are welded to the side flange of the corresponding structural column 1, there are many connection points and the connection strength is high.

Preferably, in order to further enhance the connection strength between the node connectors 3 and the structural columns 1, a corbel may be provided between the side flange of each structural column 1 and a lower end surface of the corresponding lower flange steel plate 32.

In this embodiment, the welding process is only used at the node connectors 3 and the joints between the node connectors 3 and the structural columns 1, which reduces the number of structures that need to be welded, simplifies the structure of the welding portion, and further reduces the construction difficulty of the welding. For wet connection with complex construction condition, cumbersome procedure and long construction period, the step-by-step pouring method is used. The concrete beam 2 between the two circumferential reinforcing plates 4 is poured first, and then the concrete beam 2 between the circumferential reinforcing plates 4 and the structural columns 1 is poured. Compared with the integral pouring, the volume of concrete of single pouring is reduced and the shape is regular, which greatly reduces the construction difficulty. Therefore, the construction method for the prefabricated concrete beam-column node according to the present embodiment ensures the structural strength of the concrete beam-column node, and is economical, effective, and convenient for construction.

On the basis of the above embodiments, the step S4 may include:

step S41, plugging the groove hole on each circumferential reinforcing plate 4; and step S42, placing a pair of the node connectors 3 into a formwork, and pouring the concrete beam 2 between two circumferential reinforcing plates 4.

It should be explained for the step S41 that, a plugging material is utilized to plug the groove hole on each circumferential reinforcing plate 4, and the plugging material may be selected as a common construction material such as foam plastic.

It should be explained for the step S42 that, the formwork is configured to pour a middle section of the concrete beam 2 located between the two circumferential reinforcing plates 4. When the pouring formwork is assembled, the two circumferential reinforcing plates 4 are respectively arranged at two ends of the formwork in a length direction. After the concrete is completely dry, the formwork is removed, the node connectors 3 are still connected to the concrete beam 2 due to the reserved studs on the inner wall surfaces, thereby realizing the pouring of the middle section of the concrete beam 2 and the connection between the middle section and the node connectors 3.

On the basis of the above embodiments, the step S9 may include:

step S91, removing a plugging material in each groove hole;

step S92, jacketing a mold over a joint between each structural column 1 and the corresponding node connector 3; and step S93, pouring concrete through a grouting port 311 of each node connector 3.

It should be noted that, an object of removing the plugging material in each groove hole is to pour concrete into the groove hole so as to fill the space in each groove hole, prevent the concrete beam 2 from being interrupted at the groove hole and seriously affecting the structural strength of the concrete beam 2 and the beam-column node.

In addition to the construction method for the prefabricated concrete beam-column node, a prefabricated concrete beam-column node used in the construction method for the prefabricated concrete beam-column node is provided according to the present application, which includes structural columns 1, a concrete beam 2, and node connectors 3 connecting the structural columns 1 with the concrete beam 2. The node connectors 3 are horizontally arranged at two ends of the concrete beam 2, and a grouting port 311 is defined on an upper surface of each node connector 3. A circumferential reinforcing plate 4 is arranged in each node connector 3, and a through groove hole is defined on each circumferential reinforcing plate 4. A hidden corbel 5 is welded to a side flange of each structural column 1, each hidden corbel 5 is pre-embedded in the concrete beam 2, and, the hidden corbels 5 and the structural columns 1 are welded to the node connectors 3.

Preferably, each structural column 1 includes a steel column 11 or a concrete column 12, and a hoop plate 121 is provided on an outer circumference of each concrete column 12. The hoop plate 121 is a steel plate arranged around an outer circumference of each concrete column 12, so that each hidden corbel 5 or each corbel 7 can be welded to the corresponding hoop plate 121.

According to a sectional shape of the concrete column 12, the concrete column 12 may include a hollow concrete column or a solid concrete column. According to the pouring method, the concrete column 12 may include an onsite cast column, a precast column, and a prefabricated column shown in FIG. 3 and FIG. 4. A specific type and size of the concrete column 12 are determined according to actual construction requirement with reference to the conventional technology, which will not be repeated here.

In order to reduce the construction cost and mass of the structural column 1, each structural column 1 is a hollow steel pipe column, and a specific sectional shape of each steel pipe column is designed according to the strength requirements of architectural design with reference to the conventional technology, which will not be repeated here.

Preferably, referring to FIG. 2, multiple stud holes for mounting studs are provided on each hidden corbel 5, and the hidden corbels 5 are connected to the concrete beam 2 by studs, so as to enhance the connection strength between the hidden corbels 5 and the concrete beam 2.

Preferably, multiple reserved rebar holes for mounting longitudinal rebars 6 are defined on each circumferential reinforcing plate 4, and the longitudinal rebars 6 are configured to connect the concrete beam 2 on two sides of each circumferential reinforcing plate 4. An extending direction of the longitudinal rebars 6 is the same as the length direction of the concrete beam 2, which enhances the tensile strength of the concrete beam 2. The concrete beam 2 on the two sides of the circumferential reinforcing plate 4 is not only bonded at an interface between two pouring, but can also be connected by the longitudinal rebars 6, which greatly reduces the risk of breaking of the concrete beam 2 at the pouring interface.

Preferably, referring to FIG. 2, each node connector 3 includes an upper flange steel plate 31 in contact with an upper flange of the concrete beam 2, a lower flange steel plate 32 in contact with a lower flange of the concrete beam 2, and a side steel plate 33. The side steel plate 33 is configured to connect the upper flange steel plate 31 with the lower flange steel plate 32. The grouting port 311 is defined at a front end of each upper flange steel plate 31.

The above embodiments are described in a progressive manner. Each of the embodiments is mainly focuses on describing its differences from other embodiments, and reference may be made among these embodiments with respect to the same or similar parts.

The construction method for the prefabricated concrete beam-column node according to the present application has been described in detail above. The principle and the embodiments of the present application are illustrated herein by specific examples. The above description of examples is only intended to facilitate the understanding of the method and spirit of the present application. It should be noted that, for those skilled in the art, many modifications and improvements may be made to the present application without departing from the principle of the present application, and these modifications and improvements are also deemed to fall into the protection scope of the present application defined by the claims.

The invention claimed is:

1. A construction method for a prefabricated concrete beam-column node, comprising:

assembling node connectors, and mounting studs on each node connector, wherein the studs are evenly distributed along an extension direction of the node connectors;

welding a circumferential reinforcing plate with a groove hole in the center to a middle-rear section of each node connector;

mounting a longitudinal rebar on each circumferential reinforcing plate;

filling concrete between two circumferential reinforcing plates to form a middle section;

welding a hidden corbel to a side flange of each of structural columns;

hoisting the middle section, and overlapping each node connector with the corresponding hidden corbel;

welding each node connector to the corresponding structural column; and filling concrete between the respective circumferential reinforcing plate and the corresponding structural column to form a connection section.

2. The construction method for the prefabricated concrete beam-column node according to claim 1, wherein the mounting studs on each node connector comprises:

mounting studs on an upper lower flange steel plate of each node connector;

mounting studs on a lower flange steel plate of each node connector; and mounting studs on a side steel plate located on two sides of each node connector.

3. The construction method for the prefabricated concrete beam-column node according to claim 1, wherein the overlapping each node connector with the corresponding hidden corbel comprises:

overlapping each node connector with the corresponding hidden corbel through a hidden corbel mounting hole on the node connector; and repairing welding to plug each hidden corbel mounting hole.

4. The construction method for the prefabricated concrete beam-column node according to claim 1, wherein the filling concrete between two circumferential reinforcing plates to form a middle section comprises:

plugging the groove hole on each circumferential reinforcing plate; and placing a pair of the node connectors mounted with the longitudinal rebar into a formwork, and filling concrete between the two circumferential reinforcing plates to form a middle section.

5. The construction method for the prefabricated concrete beam-column node according to claim 1, wherein the filling concrete between the respective circumferential reinforcing plate and the corresponding structural column to form a connection section comprises:

removing a plugging material in each groove hole; and filling concrete through a grouting port of each node connector.

6. A prefabricated concrete beam-column node, comprising: structural columns, a concrete beam, and node connectors connecting the structural columns with the concrete beam, wherein the node connectors are horizontally arranged at two ends of the concrete beam, and a grouting port is defined on an upper surface of each node connector;

a circumferential reinforcing plate is arranged in each node connector, and a through groove hole is defined on each circumferential reinforcing plate; and a hidden corbel is welded to a side flange of each structural column, each hidden corbel is pre-embedded in the concrete beam, and the structural columns are welded to the node connectors.

7. The prefabricated concrete beam-column node according to claim 6, wherein a plurality of reserved rebar holes for mounting longitudinal rebars are defined on each circumferential reinforcing plate.

8. The prefabricated concrete beam-column node according to claim 6, wherein each node connector comprises an upper flange steel plate in contact with an upper flange of the concrete beam, a lower flange steel plate in contact with a lower flange of the concrete beam, and a side steel plate, and the side steel plate is configured to connect the upper flange steel plate with the lower flange steel plate; and the grouting port is defined at a front end of each upper flange steel plate.

9. The prefabricated concrete beam-column node according to claim 8, wherein each structural column comprises a steel column or a concrete column, and a hoop plate is provided on an outer circumference of each concrete column.

* * * * *